US006151816A

United States Patent [19]

Bagley

[11] Patent Number: 6,151,816

[45] Date of Patent: Nov. 28, 2000

[54] PORTABLE QUILTING FRAME ASSEMBLY

[76] Inventor: Jim Bagley, 9909 S. Dream Cir., South Jordan, Utah 84095

[21] Appl. No.: 08/832,355

[22] Filed: Apr. 2, 1997

[51] Int. Cl.[7] ..... D06C 3/08

[52] U.S. Cl. ..... 38/102.21

[58] Field of Search ..... 38/102.1, 102.2, 38/102.21, 102.3, 102.4, 102.6, 102.8, 102.91; 108/1, 3, 6, 32, 117, 129; 248/460, 447, 451, 457

[56] References Cited

U.S. PATENT DOCUMENTS

| | | | |
|---|---|---|---|
| 372,707 | 11/1887 | Sanders | 38/102.21 |
| 414,184 | 11/1889 | Bentley | 38/102.21 |
| 672,809 | 4/1901 | Russell | 38/102.3 X |
| 1,326,776 | 12/1919 | Park | 38/102.21 |
| 2,000,397 | 5/1935 | Knutson | 38/102.21 |
| 4,422,251 | 12/1983 | Hedrick . | |
| 4,658,521 | 4/1987 | Thorpe . | |
| 4,677,775 | 7/1987 | Riley . | |
| 4,893,423 | 1/1990 | Heinrich . | |
| 4,944,105 | 7/1990 | Schulle | 38/102.2 X |
| 5,027,989 | 7/1991 | Nevius | 38/102.4 X |
| 5,351,424 | 10/1994 | Schulle et al. | 38/102.1 |

*Primary Examiner*—Ismael Izaguirre
*Attorney, Agent, or Firm*—Morriss, Bateman, O'Bryant & Compagni

[57] ABSTRACT

A quilting frame which is comprised of two complementary support structures each of which includes a base member, an elevation member, and a fulcrum member. The two complementary support structures are coupled by a cross member which spans the distance between the two complementary support structures. The cross member is coupled to each of the elevation members at a location near where the elevation member is coupled to the fulcrum member. Coupled to each of the fulcrum members at a fulcrum end is a rail assembly. The rail assembly is comprised of two complementary rail brace members which generally hold at least three rails upon which components of a project are disposed. The at least three rails consist of a take-up rail disposed at the fulcrum end, and at least two supply rails disposed at a supplying end of the rail assembly.

27 Claims, 11 Drawing Sheets

Tilted 15 Degrees

Tilted 30 Degrees

Tilted 45 Degrees

PORTABLE QUILTING FRAME ASSEMBLY

BACKGROUND

1. The Field of the Invention

This invention relates generally to frames and other support structures used in holding fabric or other material. More specifically, the invention is an improved frame for advantageously holding fabric so that quilting or other handiwork can be accomplished.

2. The State of the Art

The state of the art is replete with various quilting frame designs. Improvements can be loosely categorized according to whether they provide an improved overall support frame, or provide improved mechanisms for attaching fabric and other materials to the support frame. Most relevant to the present invention are the support frames which hold the fabric or other materials.

Quilting frames have progressed from the time when awkward frames were difficult to assemble and use. For example, U.S. Pat. No. 4,658,521 issued to Thorpe describes a quilting frame as seen in FIG. 1. Essentially, elongate and slotted frame members were assembled using legs which fastened to the frame members to hold them securely. However, it is quickly recognized that access to the center portion of the quilt is a difficult process. The quilt is also held in a generally horizontal position, requiring a quilter to lean over and maintain and uncomfortable posture. The frame also has various separate frame members which are of large and various sizes. furthermore, these frame members are difficult and time consuming to adjust. The result is a frame which is difficult to assemble, utilize, disassemble, and transport.

In FIG. 2, U.S. Pat. No. 4,677,775 issued to Riley, teaches a smaller quilting frame is claimed which overcomes some of the difficulties of the prior art by providing a rigid stand comprised of four legs, and a first frame which rests on the legs. A quilt is draped over the first frame on the legs. second frame which is slightly larger than the first frame is then placed over the quilt to hold it relatively tightly in place between walls of the first and second frame. Disadvantageously, the frame still holds the fabric in a horizontal position. The quilting frame is also not easily portable because of the size of the frames. Furthermore, when the quilting frame is disassembled, the legs and frames are all separate components which can be difficult to keep together.

A more advanced quilting frame which illustrates some more advanced features is taught in U.S. Pat. No. 4,893,423 issued to Heinrich and shown in FIG. 3. The '423 patent incorporated the features of using a rigid frame which is disposed so as to tilt the fabric or other material toward a user. The quilting frame also incorporated a more advanced system of using three elongate rollers on which the fabric is mounted and stretched. Disadvantageously, the angle at which the quilting frame tilts the fabric is not adjustable. Furthermore, the quilting frame cannot be disassembled easily for transport.

It would be an improvement to provide a quilting frame which is more versatile than the prior art. More specifically, it would be an improvement to provide a quilting frame which is more easily transportable by conveniently folding without disturbing a quilting work in progress. Furthermore, it would be an improvement to provide a quilting frame which is configurable in a tilting angle to provide improved access to the fabric. It would also be an improvement to provide a portable quilting frame which is sturdy and lightweight.

OBJECTS AND SUMMARY OF THE INVENTION

It is an object of the present invention to provide a portable quilting frame which can be quickly folded for storage or transport without disassembly.

It is another object to provide a portable quilting frame which provides a Z-structure profile.

It is another object to provide a portable quilting frame which can be quickly assembled after storage or transport without assembly.

It is another object to provide a portable quilting frame which does not require removal of a project from three quilting rails when the portable quilting frame is folded for storage or transport.

It is another object to provide a portable quilting frame which rapidly folds for storage and transport without the use of tools.

It is another object to provide a portable quilting frame which utilizes laminated quilting rails to provide greater strength and resistance against warping with minimum bulk.

It is another object to provide a portable quilting frame which provides a ratcheted tension mechanism having a plurality of ratchet teeth to enable fine tension control.

It is another object to provide a portable quilting frame which provides a plurality of slip points to enable the various quilting frame members to conveniently fold for storage or transport.

It is another object to provide a portable quilting frame which uses superior materials to provide substantial strength in a lightweight design.

It is another object to provide a portable quilting frame which utilizes a minimum number of quilting frame support members.

In accordance with these and other objects of the present invention, the advantages of the invention will become more fully apparent from the description and claims which follow, or may be learned by the practice of the invention.

The present invention is realized in a quilting frame which is constructed according to the principles of a preferred embodiment of the present invention. The quilting frame is comprised of two complementary support structures each of which includes a base member, an elevation member, and a fulcrum member. The two complementary support structures are coupled by a cross member which spans the distance between the two complementary support structures. The cross member is coupled to each of the elevation members at a location near where the elevation member is coupled to the fulcrum member.

Coupled to each of the fulcrum members at a fulcrum end is a rail assembly. The rail assembly is comprised of two complementary rail brace members which generally hold at least three rails upon which the material is disposed. The at least three rails consist of a take-up rail disposed at the fulcrum end, and at least two supply rails disposed at a supplying end of the rail assembly.

The over-all design of the portable quilting assembly described generally in the preferred embodiment above is advantageous in itself. This is attributable to an ability to fold without disassembly and without removal of the project from the rail assembly. However, there are several aspects of portable quilting frame which by themselves provide the ability of the portable quilting frame to function as described.

A first advantageous aspect of the portable quilting frame is the Z-structure shape formed by the assembled quilting frame. By utilizing the Z-structure, the present invention can be easily folded at pivot points located where the different support members are joined. Specifically, the portable quilting frame pivots where the base member is coupled to the elevation member, where the elevation member is coupled to the fulcrum member, and where the fulcrum member is coupled to the rail assembly.

Another advantageous aspect of the Z-structure is that by having only two elevation members (one in each of the two complementary support structures), the bulk and thus the weight of the quilting frame is thereby reduced, enabling the quilting frame to be more portable.

Another advantageous aspect of the Z-structure is that by disposing the elevation support members such that they tilt away from the user, there is more room underneath the rail assembly for knees and legs. This permits easier access, especially when more than one person is seated in front of the portable quilting assembly.

Another aspect of the invention is that a fulcrum for the rail assembly is disposed at the front of the portable quilting assembly. Specifically, the fulcrum enables the rail assembly to be tilted at various angles relative to the person situated at a front end.

Another aspect of the invention is that the rails utilized in the rail assembly are laminated. Utilizing laminated rails provides significant benefits. First, strength is increased as compared to using a single piece of hardwood. The individual layers also enable the rails the resist warping because of the various directions which the layers are all pushing and pulling. A net result are substantially straight rails.

Another aspect of the invention is a tension mechanism which utilizes ratcheting to tighten the material disposed on the rail assembly. The take-up rail utilizes a ratchet wheel with a catch arm which is leveraged so as to oppose a direction of rotation of the at least one take-up rail toward the at least two supply rails. Likewise, each of the at least two supply rails has a ratchet wheel with a catch arm also levered so as to oppose a direction of rotation of the at least two supply rails toward the take-up rail.

Another aspect of the invention is providing slip points for tilting the rail assembly at desired angles toward or away from a person at the front end. The slip points are provided as part of the fulcrum between the fulcrum member of the support structure and the rail assembly.

Another aspect of the invention is to provide additional slip points at the pivot points, enabling the various members of the support structure to slide into positions which enables all support structure members to be aligned along a common axis.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention. It is to be understood that the following description is only exemplary of the principles of the present invention, and should not be viewed as narrowing the claims which follow.

Figure 1:
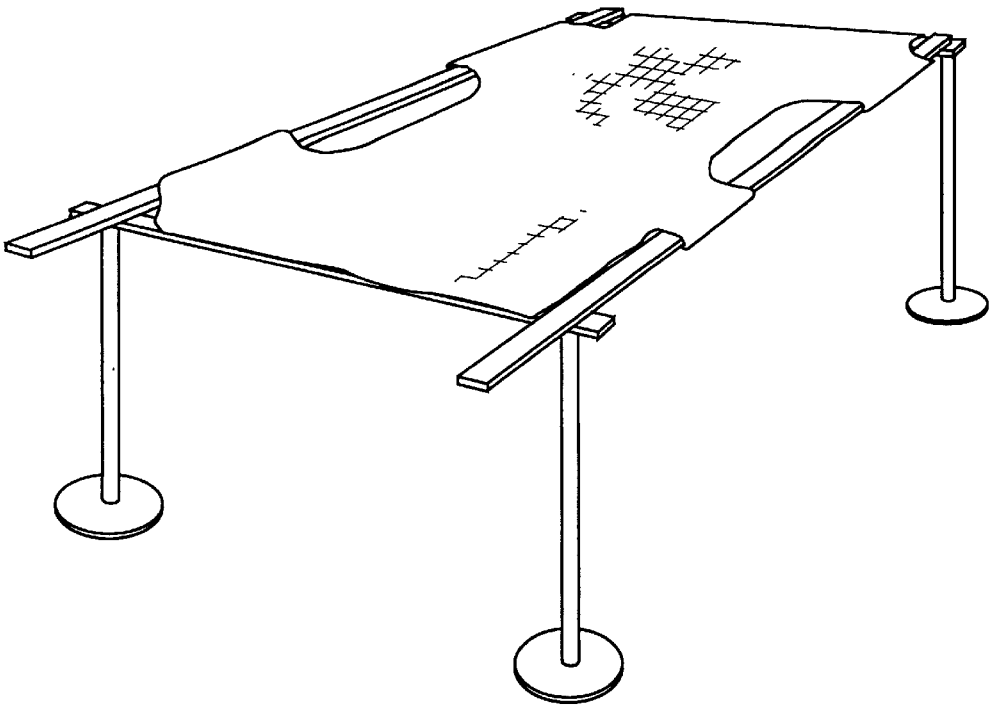
Fig. 1 (PRIOR ART)
FIG. 1 is a perspective view of a prior art quilting frame as disclosed in U.S. Pat. No. 4,658,521 issued to Thorpe.
Figure 2:
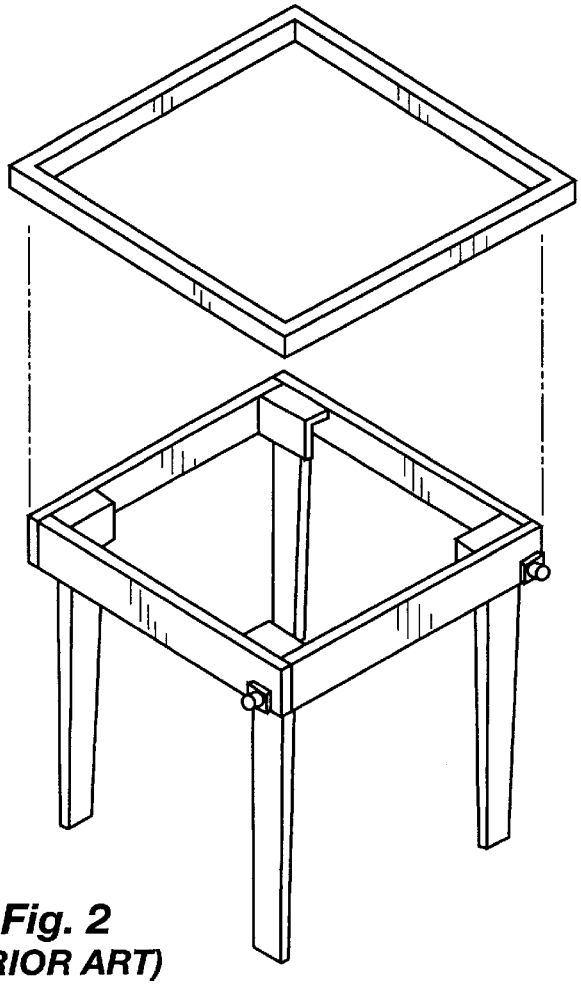
Fig. 2 (PRIOR ART)
FIG. 2 is a perspective view of a prior art quilting frame as disclosed in U.S. Pat. No. 4,677,775 issued to Riley, which teaches a smaller quilting frame which overcomes some of the drawbacks of the Thorpe patent.
Figure 3:
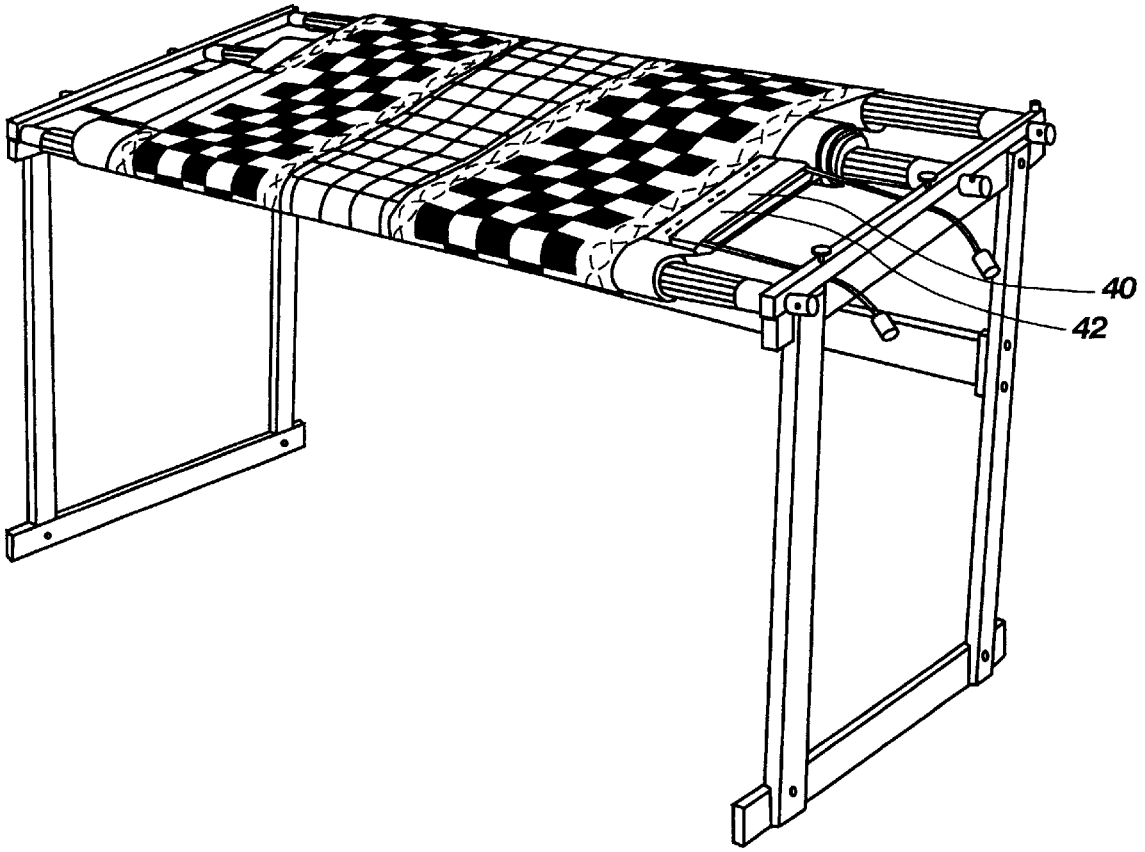
Fig. 3 (PRIOR ART)
FIG. 3 is a perspective view of a prior art quilting frame as disclosed in U.S. Pat. No. 4,893,423 issued to Heinrich, which overcomes some of the drawbacks of the Riley patent.
Figure 4:
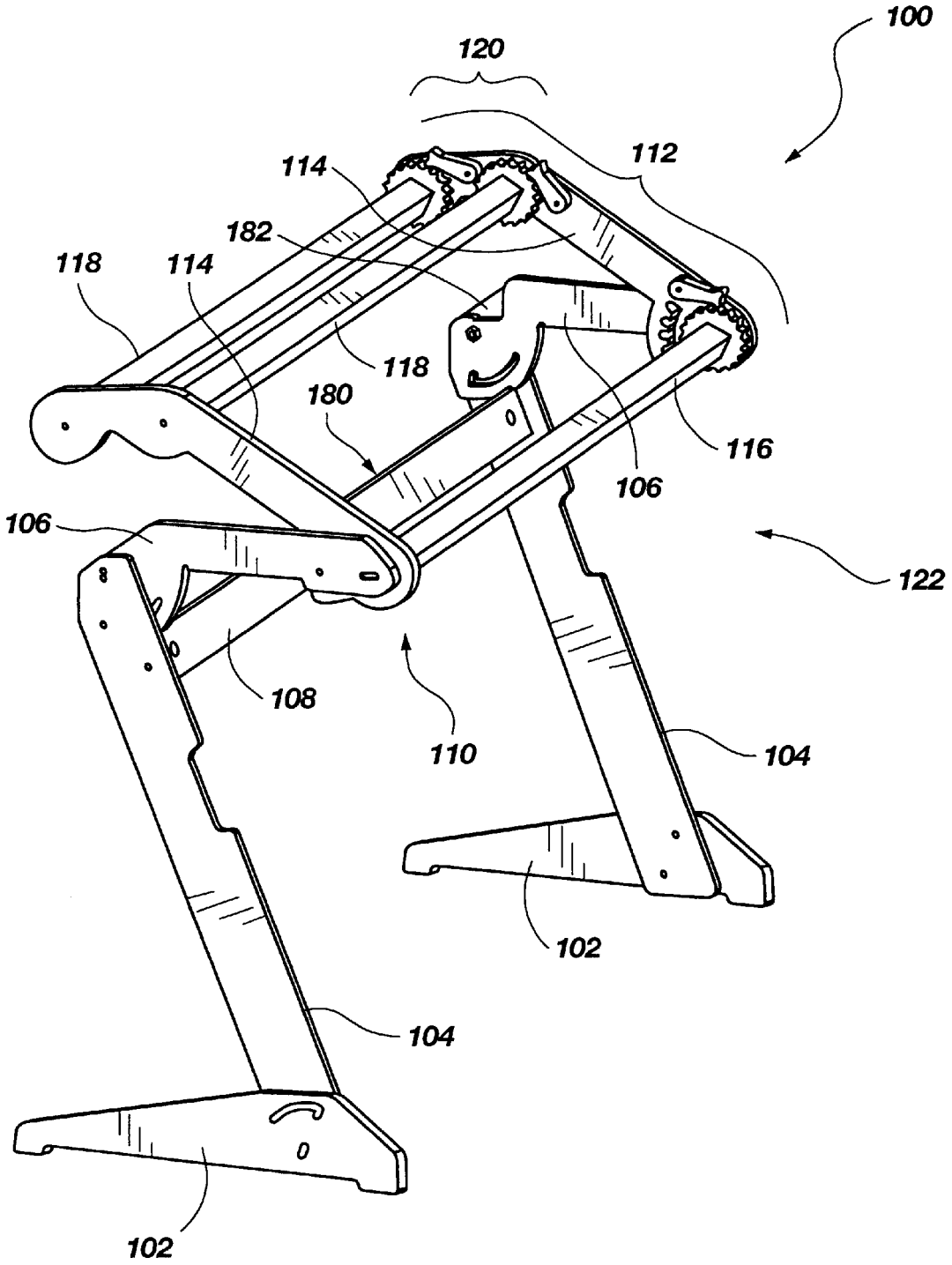
FIG. 4 is a perspective view of a preferred embodiment made in accordance with the principles of the present invention, where the preferred embodiment is shown in an upright position ready for receiving materials thereon for quilting.

The preferred embodiment is shown in FIG. 4 in a perspective view which illustrates the present invention in one configuration suitable for use. A front end 122 of the portable quilting frame 100 is shown by arrow 122. The preferred embodiment is a portable quilting frame 100 which has a support structure which is described as a "Z" shape, where the bottom of the Z shape are the two base members 102, the slanted portion of the Z shape are the two elevation members 104, and the top of the Z shape are the two fulcrum members 106. Disposed between the two elevation members 104 is a cross member 108 which provides some rigidity to the portable quilting frame 100. In addition to the rigidity, the cross member 108 also provides support for the fulcrum member 106 as will be described later.

To complete an overall description of the components of the portable quilting frame 100, coupled to each of the fulcrum members 106 at a fulcrum end 110 is a rail assembly 112. The rail assembly 112 is comprised of two complementary rail brace members 114 which generally hold at least three rails upon which the materials of a project are disposed. The at least three rails consist of a take-up rail 116 disposed at the fulcrum end 110, and at least two supply rails 118 disposed at a supplying end 120 of the rail assembly 112.

Various advantageous features of the present invention are not immediately recognized upon this brief description of the components of the portable quilting frame 100. It is necessary to examine the construction details to more completely appreciate all of the advantageous features. However, it should be noted from the outset that no tools are required to assemble or disassemble the preferred embodiment for storage or travel, other than a hand.

Figure 5:
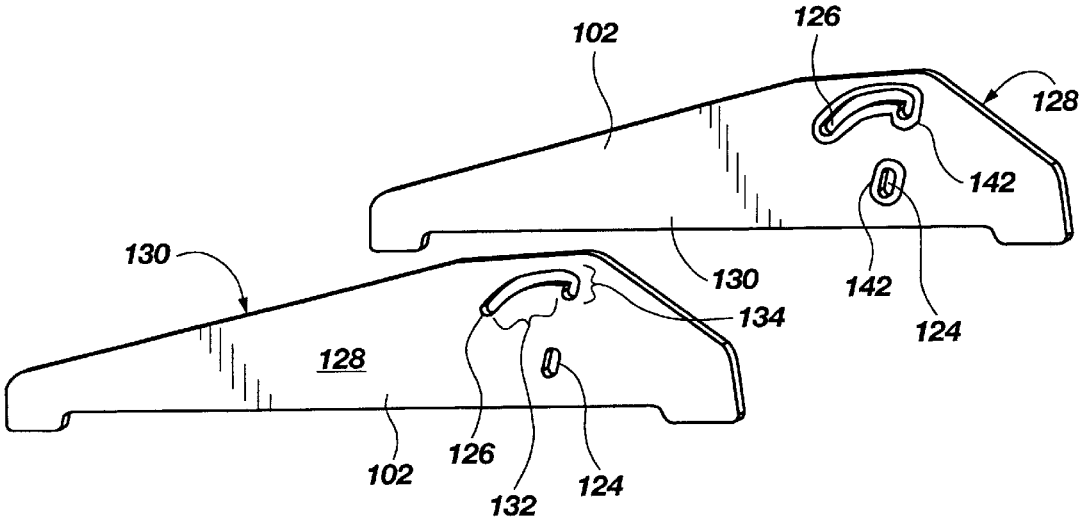
FIG. 5 is a perspective view of complementary base members disposed in upright positions and ready for attachment to elevation members.
Figure 6:
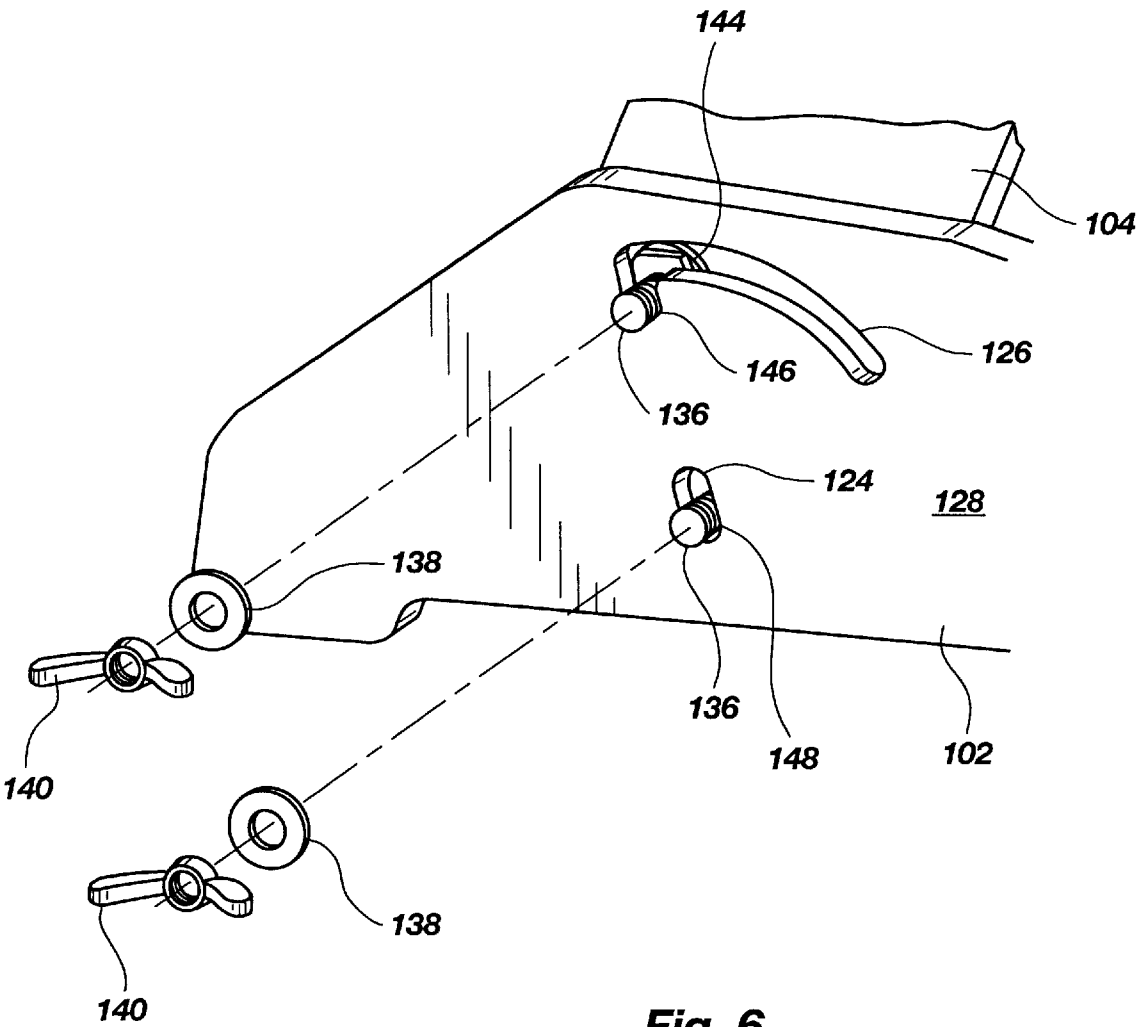
FIG. 6 is a close-up view of an outer surface of a base member showing how bolts are disposed in the apertures through the base member.

Beginning with the base members 102, they are shown in FIG. 5 in a position relative to each other as they are typically disposed in an assembled position and from a perspective angle. Each base member 102 is shown with two apertures which pass completely from one side of a base member 102 to another side. The first aperture 124 is shown from an outer side 128 as an oblong ellipsoid. The second aperture 126 is shown from the outer side 128 as consisting of a notch section 134 which runs into a curved section 132. The inner side 130 shows that the apertures 124 and 126 have a groove or countersunk channel 142 around the perimeter of the apertures. The purpose of the countersunk channel is illustrated in FIG. 6.

As viewed from the outer side 128, a bolt 136 is inserted from the inner side 130. A washer 138 is inserted over the bolt 136 and a wing nut 140 is then disposed on the bolt 136. The countersunk channel 142 thus provides an indentation for a head 144 of a bolt 136 to be disposed so as to be generally level with the inner side 130. The purpose of the oblong shape of the aperture 124 and the oblong notch section 134 is so that when the portable quilting frame 100 is in an upright position, the bolts 136 slide down into the notch to thereby hold the base members 102 securely in place so that the frame 100 does not collapse. When ready to be stored or transported, loosening the wing nuts 140 enables the bolts 136 to slide upwards in the notch, and the top bolt 146 to slide along the curved section 132 while pivoting about the bottom bolt 148. When the top bolt 146 is abutted against the end of the curved section 132, the wing nuts 140 are then tightened to keep the base members 102 aligned with the elevation members 104.

Figure 7:
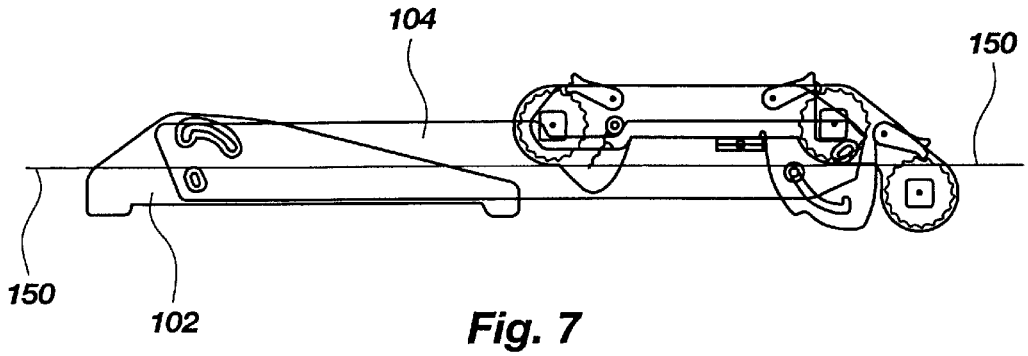
FIG. 7 is a profile view of the portable quilting frame shown folded for storage or transport, where the various support members and the rail assembly is aligned along a common axis.

FIG. 7 is provided to show the portable framing quilt 100 disposed in a folded position. For the sake of being able to show the relationship of the members in relation to the others, the outline of all members of the portable framing quilt 100 are shown, even when they would otherwise obscured. What is important to observe relative to FIGS. 5 and 6 is that the base members 102 are shown aligned along an axis 150 with the elevation members 104 when folded. Other features shown in FIG. 7 will be identified later as necessary.

Figure 8:
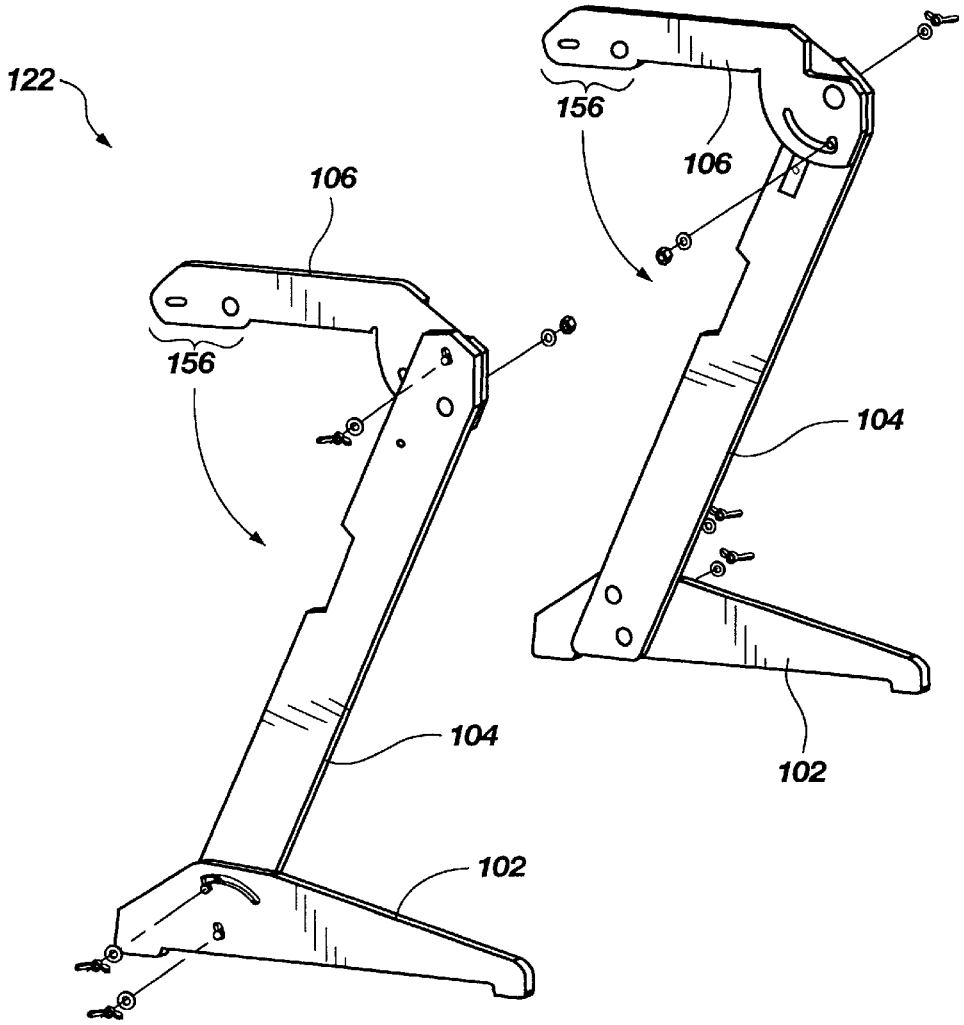
FIG. 8 is a perspective view of the support structure comprised of the base members, the elevation members and the fulcrum members, and the interconnections therebetween.

FIG. 8 provides a perspective view of the two complementary support structures without the cross member 108 or the rail assembly 112. This view is helpful to show the elevation members 104 in an upright position.

Figure 9:
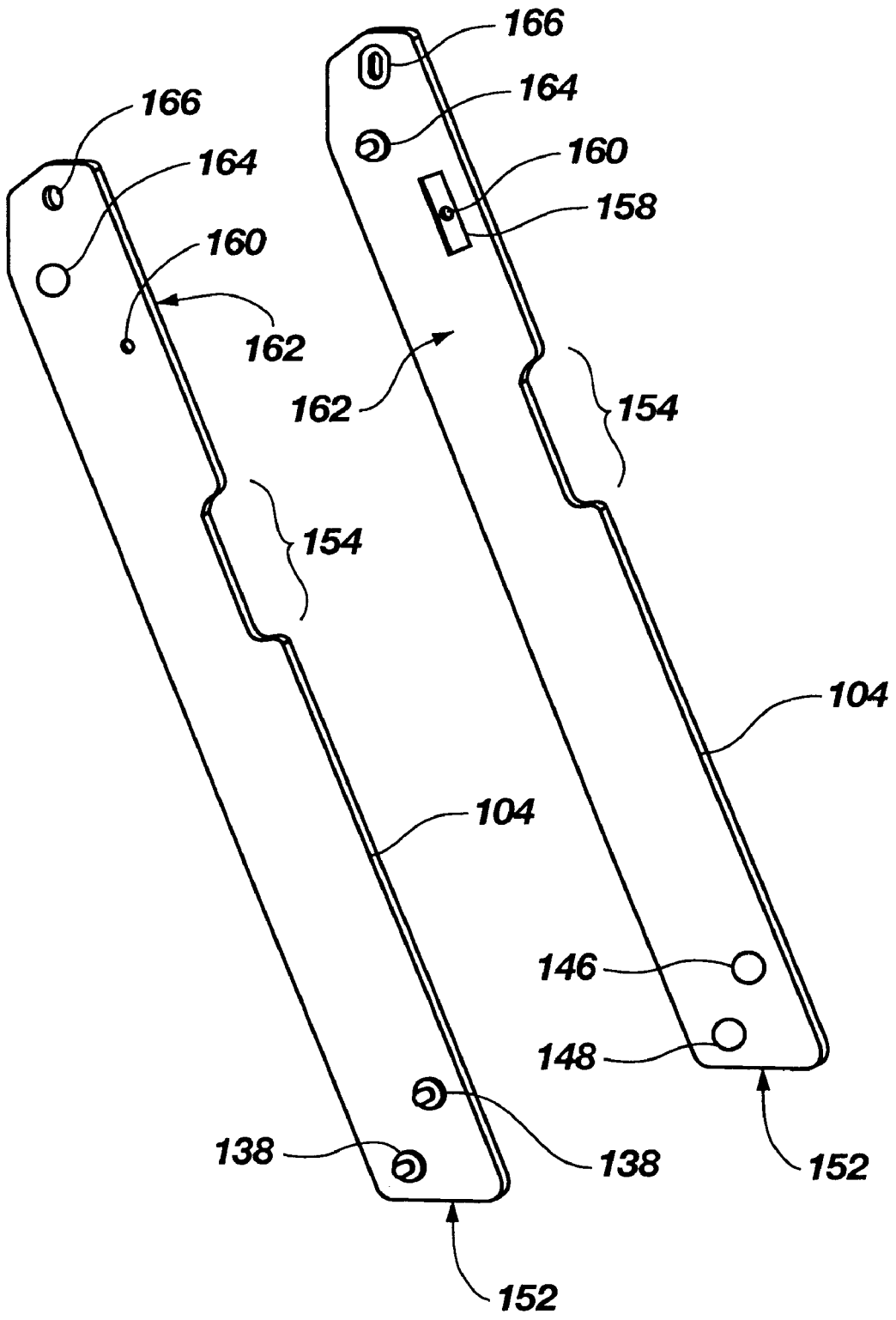
FIG. 9 is a perspective view of the elevation members in the preferred embodiment showing various apertures and indentations therein.

FIG. 9 is a perspective view of the elevation members 104 alone. It should be observed that in this upright position, a bottom edge 152 of the elevation members 104 is generally parallel with a floor. Proceeding up the elevation members 104, the next visible feature is a notch 154. The notch 154 provides an indentation 154 needed for receiving a distended section 156 (see FIG. 8) of the fulcrum member 106, as will be explained later.

A next feature of the elevation members 104 is a groove or indentation 158 formed on an inside 162 of the elevation members 104 for the cross member 108 to be inserted. By forming the indentation 158, the cross member 108 is unable to twist out of position despite a screw hole 160 being provided for only a single screw (not shown). Requiring only a single screw minimizes the weight of the portable quilting frame 100.

Figure 10:
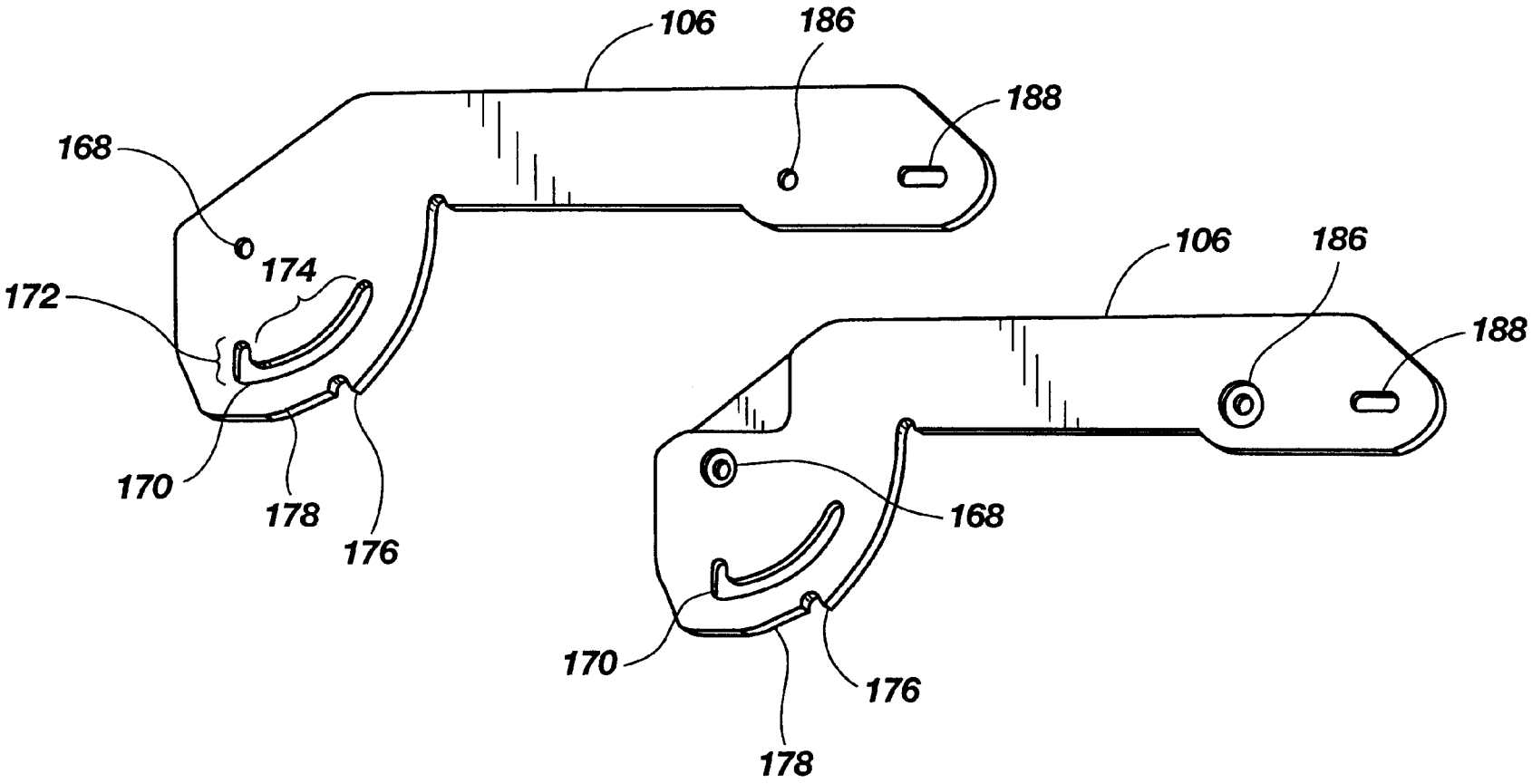
FIG. 10 is a perspective view of the fulcrum members in the preferred embodiment showing the apertures therethrough.

A next feature is a combination of apertures 164, 166 on a pivoting end of the elevation member 104. The purpose for the shape of the apertures 164, 166 is more readily understood when seen in conjunction with the corresponding apertures in the fulcrum members 106. Therefore, looking back at FIG. 8, we see that the fulcrum members 106 are coupled to the elevation members 104 utilizing two screws at the apertures 164 and 166. Now looking ahead to FIG. 10, what is important to recognize is that while aperture 166 on the elevation member 104 forms an oblong notch, the corresponding aperture 168 in the fulcrum member 106 is circular. Likewise, while the aperture 164 (see FIG. 9) is shown with a circular shape (although a bolt is shown inserted therethrough), the corresponding aperture 170 is shown having a notched section 172 and a curved section 174.

The significance of this configuration becomes apparent when examining a procedure for setting up and taking down the portable quilting frame 100. Assuming that the portable quilting frame 100 is in a position as shown in FIG. 7. When the fulcrum members 106 are pivoted away from the elevation members 104, bolts slide along the curved sections 174 of the fulcrum members 106, approaching the notched section 172. When the bolt reaches the notched section 172, the fulcrum member 106 is free to slide downward so that the bolts are disposed within the notched section 172 of aperture 170. Likewise, the bolts through the oblong apertures 166 of the elevation members 104 are also able to slide downward to a bottom end of the apertures 166.

It should also be noted that when the fulcrum members 106 have pivoted sufficiently to be able to slide downward, notches 176 have also moved past the cross member 108. Consequently, as the fulcrum members 106 slide downward, the notches 176 catch the cross member 108, further preventing movement of the fulcrum members 106, as well as providing additional support. Furthermore, the angle on fulcrum edge 178 is also made so as to generally rest against an opposing top edge 180 (see FIG. 4) of the cross member 108.

Assume that the base members 102 have been pivoted so as to be in an extended position with respect to the elevation members 104. Furthermore, assume that the fulcrum members 106 have also been extended with respect to the elevation members 104. Up to this point, each of the support members 102, 104 and 106 have two positions: an extended position for operation of the portable quilting frame 100, and a folded position so that the support members 102, 104 and 106 are all aligned along the common axis 150 (see FIG. 7). However, the versatility of the present invention is again made apparent by a closer examination of the rail assembly 112.

It will now be assumed that the rail assembly 112 is not yet in an extended position with respect to the fulcrum members 106. Consequently, the rail brace members 114 are not yet pivoted above the fulcrum members 106 as shown in FIG. 4. Nevertheless, FIG. 4 shows that the rail brace members at the supplying end 120 are able to partially rest in a groove 182 in the fulcrum members 106 as the rail brace members 114 curve around the fulcrum members 106. The groove 182 is shown closer and at a more advantageous angle in FIG. 11.

Figure 11:
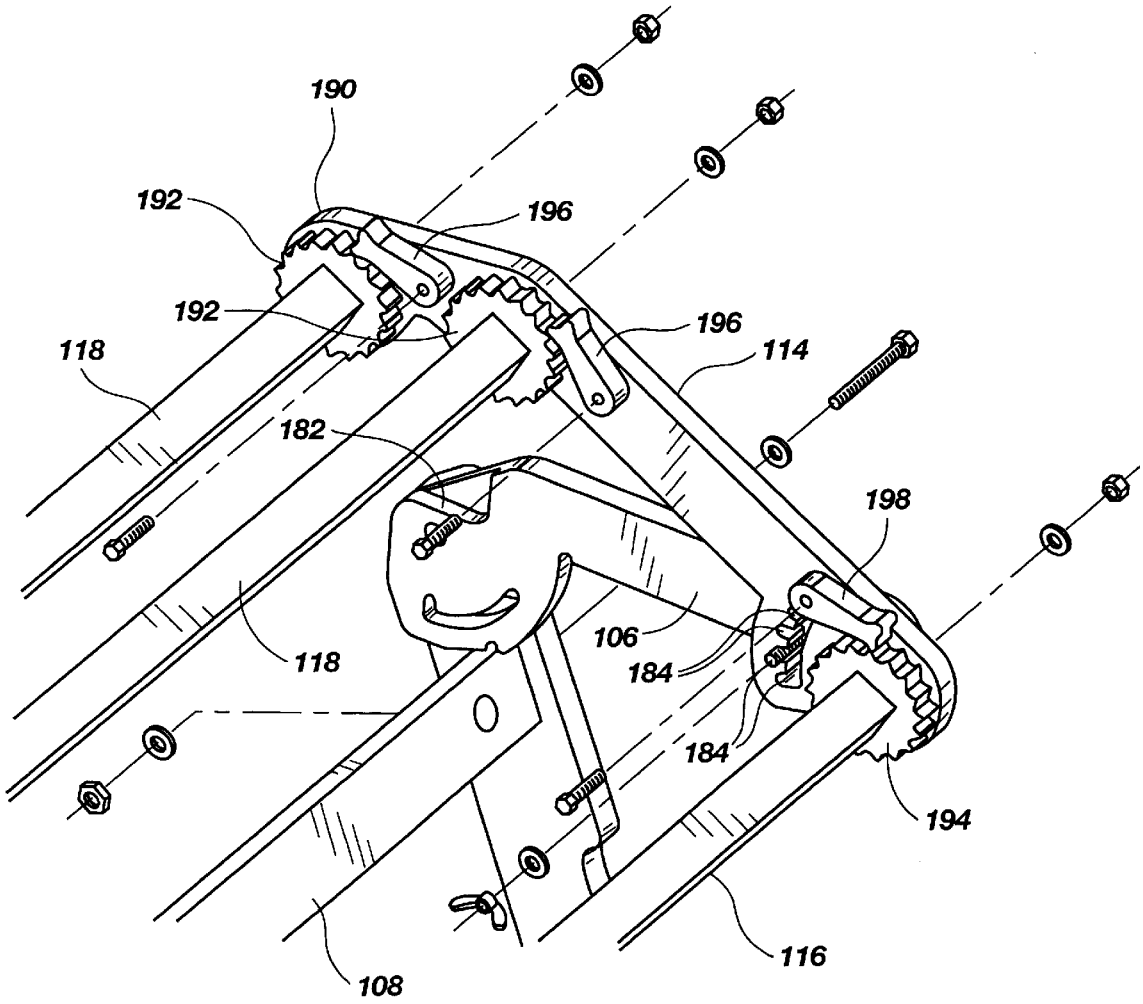
FIG. 11 is a close-up perspective view of a portion of the rail assembly including the ratchet wheels and catch arms, and the support structure including the fulcrum member, the cross member and the elevation member.

FIG. 11 also illustrates that when the rail assembly 112 is utilized, it can advantageously be disposed at several different angles with respect to the fulcrum members 106. This is accomplished by using slip points 184. A single bolt (not shown) through aperture 186 (see FIG. 10) provides the necessary support on which the rail assembly 112 rests at the various slip point angles. Likewise, the oblong aperture 188 (see FIG. 10) enables the rail assembly 112 to slide forward and backward so as to respectively disengage and engage the slip points 184 as desired. The slip points 184 advantageously create a fulcrum at the front end 122 of the portable quilting frame 100. This conveniently situated fulcrum enables a user to quickly and easily position the rail assembly 112 as desired.

Figure 12A:
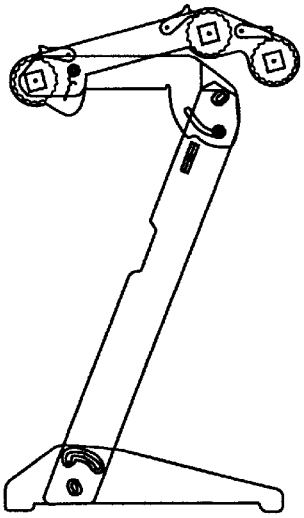
FIG. 12A is a profile view of the portable quilting frame with the rail assembly disposed at a 15 degree angle relative to horizontal.
Figure 12B:
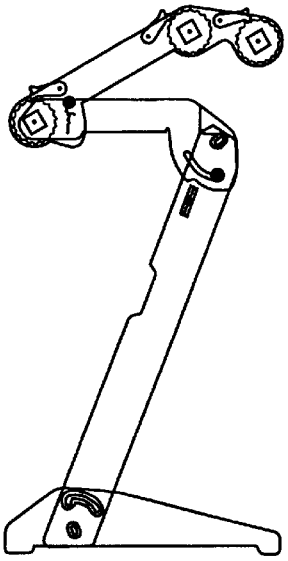
FIG. 12B is a profile view of the portable quilting frame with the rail assembly disposed at a 30 degree angle relative to horizontal.
Figure 12C:
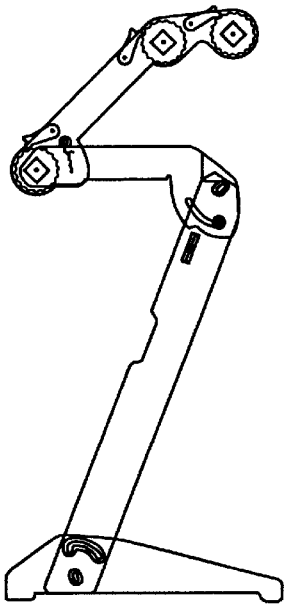
FIG. 12C is a profile view of the portable quilting frame with the rail assembly disposed at a 45 degree angle relative to horizontal.
Figure 13:
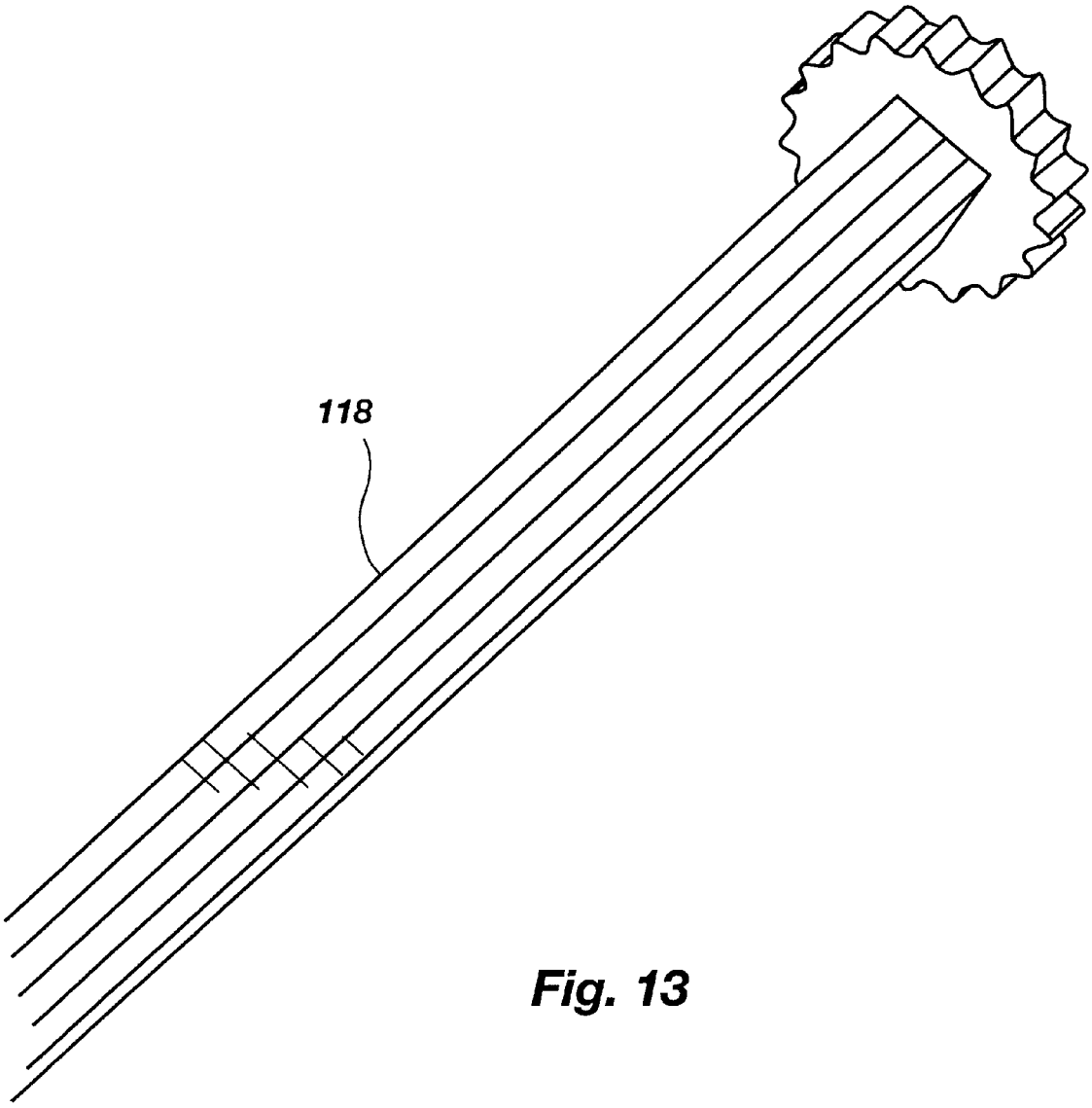
FIG. 13 is a drawing of the laminated layers which make up the rails on which quilting material is wound.

It should be realized that the rail assembly 112 does not have to be raised through the use of the slips points 184 if the user desired the work to be generally horizontal. However, in the preferred embodiment of the present invention, it is convenient to provide a plurality of angles at which the rail assembly can be set. These pre-set angles are shown in FIGS. 12A, 12B and 12C. Specifically, FIG. 12A shows the rail assembly 112 raised so as to be disposed at a 15 degree relative to horizontal. FIGS. 12B and 12C show the rail assembly disposed at an angle of 30 degrees and 45 degrees, respectively. During construction of the fulcrum members 106, the slip points 184 can be cut at almost any desired angles.

FIG. 11 also illustrates how the take-up rail 116 and the supply rails 118 are able to be held so as to provide tension. The tension mechanism is provided via a ratchet assembly disposed on a ratcheting side 190 of the rail assembly 112. Each ratchet assembly is comprised of a ratchet wheel 192, 194 and a leveraged catch arm 196, 198. The catch arm 198 of the take-up rail 116 is positioned so as to oppose its ratchet wheel 194 from rotating toward the supply rails 118. Similarly, the catch arms 196 of the supply rails 118 are positioned so as to oppose their ratchet wheels 192 from rotating toward the take-up rail 116. This simple yet effective tension mechanism enables tension to be quickly added or removed from any materials disposed on the rail assembly 112. Therefore, increasing tension consists of the steps of pushing the catch arms 196 so as to engage teeth of the ratchet wheels 192, and then rotating the take-up rail 116 while engaging the catch arm 198 on the ratchet wheel 194. Tension is then easily removed by lifting up on the catch arm 198, or both catch arms 196.

The present invention also includes the feature of using a material other than just solid hardwood pieces for the take-up rail 116 and the supplying rails 118. A problem inherent to the rails 116, 118 is that they are generally under tension for a significant amount of time. This is especially true if a work in progress is left on the rail assembly 112 while the portable quilting frame 100 is left standing or stored with a work in progress left on the rails. The user might not release the tension from the materials and therefore generate a significant amount of stress on the rails 116, 118. The present invention includes the use of laminated rails to provide stronger rails 116, 118 which are inherently better able to resist warping under tension.

It should be noted that the preferred embodiment of the present invention has substantial leg room, where the elevational members and rail assembly do not interfere with a person's legs being inserted beneath the rail assembly. In this way, a person can get as close as possible to work disposed on the rail assembly.

It is also worth noting that the Z-shape frame can also be reversed. However, several modifications are required, such as elimination of the fulcrum members, where the rail assembly is now substituted for the function of the fulcrum members. The reverse-Z shape, however, can still provide many of the advantages of the present invention.

It should also be mentioned that the rails utilized in the rail assembly are laminated. Utilizing laminated rails increases strength as compared to using a single piece of hardwood. Thus, the rails can better resist warping. The result is rails that are substantially straight.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A portable Z-shaped quilting frame assembly for holding and making accessible to a user at least one material for quilting, wherein said quilting frame assembly is comprised of:

at least two complementary support structures for elevating a rail assembly, wherein each of the at least two complementary support structures is comprised of:

a base member disposed generally parallel to a floor and having an attaching end towards a front end of the portable quilting frame;

an elevation member coupled at a first pivoting end to the attaching end of the base member, wherein the elevation member is tilted away from the front end toward a back end, and having a second pivoting end opposite the first pivoting end;

a fulcrum member coupled at an attaching end to the second pivoting end of the elevation member and disposed so as to direct a fulcrum end toward the front end; and the rail assembly coupled at an attaching end to the fulcrum end of the fulcrum member.

2. The portable Z-shaped quilting frame assembly as defined in claim 1 wherein each of the base members further comprises a pivoting means for enabling the base member to pivot relative to the elevation member until a length of the base member shares a common axis with a length of the elevation member.

3. The portable Z-shaped quilting frame assembly as defined in claim 2 wherein each of the fulcrum members further comprises a pivoting means for enabling the fulcrum member to pivot relative to the elevation member until a length of the fulcrum member shares the common axis with the length of the elevation member.

4. The portable Z-shaped quilting frame assembly as defined in claim 3 wherein the rail assembly includes a pivoting means for enabling the rail assembly to pivot relative to the fulcrum member until a length of the rail assembly shares the common axis with the length of the fulcrum member.

5. The portable Z-shaped quilting frame assembly as defined in claim 1 wherein the portable Z-shaped quilting frame is further comprised of a cross member disposed between the at least two complementary support structures to provide rigidity to the quilting frame.

6. The portable Z-shaped quilting frame assembly as defined in claim 5 wherein the cross member is disposed between the elevation members.

7. The portable Z-shaped quilting frame assembly as defined in claim 2 wherein the pivoting means of the base members is further comprised of:

a first aperture for receiving a first bolt therethrough, wherein the first bolt also passes through the elevation means, and wherein the first aperture is formed as a slot having a length which enables the first bolt to slide along a length of the slot when the first bolt is not tightly fastened; and a second aperture for receiving a second bolt therethrough, wherein the second bolt also passes through the elevation means, and wherein the second aperture includes a slot segment coaxial with the first aperture, and a curved segment which defines an arc segment about the first aperture which enables the second bolt to slide along the slot segment and the curved segment when the second bolt is not tightly fastened.

8. The portable Z-shaped quilting frame assembly as defined in claim 3 wherein the pivoting means of the fulcrum members is further comprised of:

a first aperture for receiving a first bolt therethrough, wherein the first bolt also passes through a slotted aperture in the elevation means;

a second aperture for receiving a second bolt therethrough, wherein the second bolt also passes through the elevation means, and wherein the second aperture includes a slot segment coaxial with the first aperture, and a curved segment which defines an arc segment about the first aperture which enables the second bolt to slide along the slot segment and the curved segment when the second bolt is not tightly fastened.

9. The portable Z-shaped quilting frame assembly as defined in claim 1 wherein the rail assembly is further comprised of at least two rail brace members for holding at least three rail members.

10. The portable Z-shaped quilting frame assembly as defined in claim 9 wherein the fulcrum members are further comprised of:

a first aperture at the fulcrum end for receiving a first bolt therethrough and holding the first bolt generally immobile, wherein the first bolt is a slip point bolt for supporting the rail assembly; and a second aperture for receiving a second bolt therethrough at the fulcrum end, wherein the second bolt is coupled to one of the at least two rail brace members, and wherein the second aperture is slotted, thereby enabling the second bolt to slide along the slotted aperture when the second bolt is not tightly fastened, and thereby enabling the first bolt to engage and disengage slips points on the rail brace members.

11. The portable Z-shaped quilting frame assembly as defined in claim 10 wherein each of the at least two rail brace members is comprised of an angle adjustment end for adjusting an angle of the rail brace member with respect to the fulcrum members, and including a plurality of slip points for catching the first bolt and supporting the rail brace member thereon.

12. The portable Z-shaped quilting frame assembly as defined in claim 11 wherein each of the at least two rail brace members is comprised of:

a first aperture at the angle adjustment end for receiving a second bolt therein; and a second aperture comprised of a curved segment having a plurality of notches extending therefrom which function as the slip points, wherein the plurality of notches extend away from the first aperture, and wherein the curved segment defines an arc segment about the first aperture.

13. The portable Z-shaped quilting frame assembly as defined in claim 11 wherein the at least three rail members are comprised of:

at least one take-up rail disposed at the angle adjustment end, wherein the at least one take-up rail rotates about a lengthwise axis between the at least two rail brace members; and at least two supply rails disposed at a supplying end of the at least two rail brace members, wherein the at least two supply rails rotate about a lengthwise axis between the at least two rail brace members.

14. The portable Z-shaped quilting frame assembly as defined in claim 13 wherein the at least one take-up rail is further comprised of a ratchet wheel disposed at a distal end between the at least one take-up rail and a rail brace member disposed at the distal end.

15. The portable Z-shaped quilting frame assembly as defined in claim 14 wherein the rail brace member disposed at the distal end further comprises a catch arm disposed to catch teeth of the take-up rail ratchet wheel.

16. The portable Z-shaped quilting frame assembly as defined in claim 13 wherein each of the at least two supply rails is further comprised of a ratchet wheel disposed at a distal end between each of the at least two supply rails and a rail brace member disposed at the distal end.

17. The portable Z-shaped quilting frame assembly as defined in claim 16 wherein the rail brace member disposed at the distal end further comprises a catch arm disposed to catch teeth of the supply rail ratchet wheel.

18. The portable Z-shaped quilting frame assembly as defined in claim 9 wherein each of the at least three rail members is further comprised of a plurality of rail layers coupled together to thereby form a single rail member.

19. The portable Z-shaped quilting frame assembly as defined in claim 18 wherein the plurality of rail layers is selected from the group of rail layers consisting of wood and wood composites.

20. A portable Z-shaped quilting frame assembly for holding and making accessible to a user at least one material for quilting or other handiwork, wherein the quilting frame assembly is pivotable at a front end of the quilting frame assembly, said quilting frame assembly being comprised of:

a support structure for elevating a rail assembly, wherein the support structure includes the front end, a back end, and a fulcrum member disposed at a top end of the support structure, wherein the fulcrum member has a fulcrum end adjacent to the front end of the quilting frame assembly; and a rail assembly coupled to the fulcrum end of the fulcrum member, and wherein the at least one material is disposed on the rail assembly.

21. The portable Z-shaped quilting frame assembly as defined in claim 20 wherein the rail assembly is comprised of a plurality of rails for holding the at least one material, and wherein each of the plurality of rails is further comprised of a plurality of rail layers coupled together to thereby form a single rail member, wherein the plurality of rail layers is selected from the group of rail layers consisting of wood and wood composites.

22. The portable Z-shaped quilting frame assembly as defined in claim 20 wherein the rail assembly includes a ratchet wheel and a catch mechanism for impeding rotation of the ratchet wheel for each rail of the rail assembly.

23. The portable Z-shaped quilting frame assembly as defined in claim 20 wherein the fulcrum end includes a plurality of slip points for adjusting an angle at which the rail assembly pivots away from the fulcrum member.

24. A portable Z-shaped quilting frame assembly for holding and making accessible to a user at least one material for quilting or other handiwork, wherein the quilting frame assembly is capable of folding along a common axis, said quilting frame assembly being comprised of:

at least two complementary support structures for elevating a rail assembly, and whose members are pivotable so as to be aligned along the common axis in a portable configuration, wherein each of the at least two complementary support structures is comprised of;

a base member disposed generally parallel to a floor and having an attaching end towards a front end of the portable quilting frame;

an elevation member coupled at a first pivoting end to the attaching end of the base member, wherein the elevation member is tilted away from the front end toward a back end, and having a second pivoting end opposite the first pivoting end;

a fulcrum member coupled at an attaching end to the second pivoting end of the elevation member and disposed so as to direct a fulcrum end toward the front end; and a rail assembly coupled to the support structure which is pivotable so as to be aligned along the common axis of the support structure.

25. A portable Z-shaped quilting frame assembly for holding and making accessible to a user at least one material for quilting, wherein the at least one material is tightened on the quilting frame assembly so as facilitate working with the least one material, said quilting frame assembly being comprised of:

a support structure for elevating a rail assembly; and the rail assembly coupled to the support structure, wherein the rail assembly is comprised of a plurality of rails for holding the at least one material, wherein each rail of the plurality of rails is comprised of a ratchet wheel disposed at a distal side of the rail assembly, between each rail of the plurality of rails and a rail brace member disposed at the distal side, and wherein the rail brace member further comprises an actuable ratchet wheel locking means which prevents rotation of each of the ratchet wheels when actuated, wherein the rail assembly is ratcheted to thereby tighten the material which is disposed thereon.

26. A portable Z-shaped quilting frame assembly for holding and making accessible to a user at least one material for quilting or other handiwork, wherein said quilting frame assembly is comprised of:

at least two complementary support structures for elevating a rail assembly, wherein each of the at least two complementary support structures is comprised of:

a base member disposed generally parallel to a floor and having an attaching end towards a back end of the portable quilting frame;

an elevation member coupled at a first pivoting end to the attaching end of the base member wherein the elevation member is tilted away from the back end toward a front end, and having a second pivoting end opposite the first pivoting end;

the rail assembly coupled at An attaching end to the second pivoting end of the elevation member.

27. A method for assembling a portable Z-shaped quilting frame assembly for holding and making accessible to a user at least one material for quilting, wherein the method comprises the steps of:

(a) providing a Z-shaped support structure for elevating a rail assembly, wherein the support structure is disposed to provide maximum legroom because interfering support structure is disposed away from a front end of the quilting frame assembly;

(b) unfolding the portable Z-shaped quilting frame assembly at pivot points from a collapsed position wherein rails of the quilting frame assembly are disposed in a storage configuration, and wherein the assembly is tightened at the pivot points by way of hand tightening devices when a user desires to utilize the quilting frame assembly; and (c) untightening the portable Z-shaped quilting frame assembly at the pivot points to thereby enable the assembly to collapse to a folded position without requiring the use of tools when the user desires to disassemble the quilting frame assembly.

* * * * *